US010137455B2

(12) United States Patent
Cook et al.

(10) Patent No.: US 10,137,455 B2
(45) Date of Patent: Nov. 27, 2018

(54) LOOSEFILL INSULATION BLOWING MACHINE WITH REDUCED SOUND RATINGS

(71) Applicant: Owens Corning Intellectual Capital, LLC, Toledo, OH (US)

(72) Inventors: David M. Cook, Granville, OH (US); Christopher M. Relyea, Columbus, OH (US); Brandon Robinson, Sylvania, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 719 days.

(21) Appl. No.: 14/680,103

(22) Filed: Apr. 7, 2015

(65) Prior Publication Data

US 2016/0296941 A1 Oct. 13, 2016

(51) Int. Cl.

| | |
|---|---|
| ***B02C 18/00*** | (2006.01) |
| ***B02C 18/22*** | (2006.01) |
| ***B02C 18/14*** | (2006.01) |
| ***E04F 21/08*** | (2006.01) |
| *E04B 1/76* | (2006.01) |

(52) U.S. Cl.

CPC ..... *B02C 18/2291* (2013.01); *B02C 18/142* (2013.01); *B02C 18/2216* (2013.01); *E04F 21/085* (2013.01); *E04B 1/7604* (2013.01); *Y10S 241/605* (2013.01)

(58) Field of Classification Search

CPC ..... B02C 18/2291; B02C 18/142; B02C 18/2216; E04F 21/085; E04B 1/7604

USPC ..... 241/18, 236

See application file for complete search history.

(56) References Cited

U.S. PATENT DOCUMENTS

| | | | |
|---|---|---|---|
| 3,905,444 | A | 9/1975 | Evans, Jr. |
| 5,094,318 | A | 3/1992 | Maeda et al. |
| 5,170,615 | A | 12/1992 | Strahlen et al. |

(Continued)

OTHER PUBLICATIONS

Wayback Machine Snapshot of HVAC Web Tech Full Load Current of Motors Chart Accessed Oct. 6, 2017 (http://www.hvacwebtech.com/motoramps.htm).*

(Continued)

*Primary Examiner* — Faye Francis

(74) *Attorney, Agent, or Firm* — MacMillan, Sobanski & Todd, LLC

(57) ABSTRACT

A machine for distributing loosefill insulation material from a package of compressed loosefill insulation material is provided. The machine includes a chute having an inlet end and an outlet end. The inlet end is configured to receive compressed loosefill insulation material. The machine also includes a lower unit. The lower unit has a shredding chamber with a plurality of shredders configured to condition the loosefill insulation material thereby forming conditioned loosefill insulation material. The plurality of shredders is driven by one or more motors. A discharge mechanism is mounted to receive the loosefill insulation material. The discharge mechanism is configured to distribute the conditioned loosefill insulation material into an airstream. A blower is configured to provide the airstream flowing through the discharge mechanism. A sound chamber is configured to receive the one or more motors and further configured to reduce the sound rating emanating from the machine.

19 Claims, 7 Drawing Sheets

(56) References Cited

U.S. PATENT DOCUMENTS

| | | | | |
|---|---|---|---|---|
| 5,431,004 | A | 7/1995 | Menegatto | |
| 5,829,649 | A * | 11/1998 | Horton | B02C 13/10 222/238 |
| 5,865,119 | A | 2/1999 | Michalik | |
| 6,183,837 | B1 | 2/2001 | Kim | |
| 6,189,649 | B1 | 2/2001 | Nitschke | |
| 6,749,929 | B1 | 6/2004 | Enkler et al. | |
| 7,343,715 | B2 | 3/2008 | Ito et al. | |
| 8,529,120 | B2 * | 9/2013 | Ulanski | B01F 15/00831 241/282.1 |
| 8,662,246 | B2 | 3/2014 | Classen et al. | |
| 8,888,930 | B2 | 11/2014 | Jerg et al. | |
| 2004/0206377 | A1 | 10/2004 | Griffin et al. | |
| 2007/0247009 | A1 * | 10/2007 | Hoffman | F04D 25/0606 310/51 |
| 2011/0084091 | A1 * | 4/2011 | Evans | E04F 21/085 222/1 |
| 2015/0328642 | A1 * | 11/2015 | Shegerian | B02C 18/16 241/30 |
| 2016/0053473 | A1 * | 2/2016 | Hartmann | B02C 18/24 241/32.5 |

OTHER PUBLICATIONS

PDF version of HVAC Web Tech Full Load Current of Motors Chart Accessed Oct. 16, 2017 (http://www.hvacwebtech.com/motoramps.htm).*

* cited by examiner

LOOSEFILL INSULATION BLOWING MACHINE WITH REDUCED SOUND RATINGS

BACKGROUND

When insulating buildings and installations, a frequently used insulation product is loosefill insulation material. In contrast to the unitary or monolithic structure of insulation materials formed as baits or blankets, loosefill insulation material is a multiplicity of discrete, individual tufts, cubes, flakes or nodules. Loosefill insulation material is usually applied within buildings and installations by blowing the loosefill insulation material into an insulation cavity, such as a wall cavity or an attic of a building. Typically loosefill insulation material is made of glass fibers although other mineral fibers, organic fibers, and cellulose fibers can be used.

Loosefill insulation material, also referred to as blowing wool, is typically compressed in packages for transport from an insulation manufacturing site to a building that is to be insulated. Typically the packages include compressed loosefill insulation material encapsulated in a bag. The bags can be made of polypropylene or other suitable material. During the packaging of the loosefill insulation material, it is placed under compression for storage and transportation efficiencies. Typically, the loosefill insulation material is packaged with a compression ratio of at least about 10:1.

The distribution of loosefill insulation material into an insulation cavity typically uses an insulation blowing machine that conditions the loosefill insulation material to a desired density and feeds the conditioned loosefill insulation material pneumatically through a distribution hose. Insulation blowing machines typically contain one or more motors configured to drive shredding mechanisms, rotary valves and discharge mechanisms. The motors, shredding mechanisms, rotary valves and discharge mechanisms often operate at elevated sound levels.

It would be advantageous if insulation blowing machines could be improved to make them quieter.

SUMMARY

The above objects as well as other objects not specifically enumerated are achieved by a machine for distributing loosefill insulation material from a package of compressed loosefill insulation material. The machine includes a chute having an inlet end and an outlet end. The inlet end is configured to receive compressed loosefill insulation material. The machine also includes a lower unit. The lower unit has a shredding chamber configured to receive the compressed loosefill insulation material from the outlet end of the chute. The shredding chamber includes a plurality of shredders configured to shred, pick apart and condition the loosefill insulation material thereby forming conditioned loosefill insulation material. The plurality of shredders is driven by one or more motors. A discharge mechanism is mounted to receive the conditioned loosefill insulation material exiting the shredding chamber. The discharge mechanism is configured to distribute the conditioned loosefill insulation material into an airstream. A blower is configured to provide the airstream flowing through the discharge mechanism. A sound chamber is configured to receive the one or more motors and further configured to reduce the sound rating emanating from the machine.

According to this invention there is also provided a machine for distributing loosefill insulation material from a package of compressed loosefill insulation material. The machine includes a chute having an inlet end and an outlet end. The inlet end configured to receive compressed loosefill insulation material. The machine also includes a lower unit having a shredding chamber configured to receive the compressed loosefill insulation material from the outlet end of the chute. The shredding chamber includes a plurality of shredders configured to shred, pick apart and condition the loosefill insulation material thereby forming conditioned loosefill insulation material. The plurality of shredders is driven by one or more motors. A discharge mechanism is mounted to receive the conditioned loosefill insulation material exiting the shredding chamber. The discharge mechanism is configured to distribute the conditioned loosefill insulation material into an airstream. A blower is configured to provide the airstream flowing through the discharge mechanism. A motor enclosure is configured to enclose the one or more motors. The motor enclosure is configured to receive a receive a flow of air and form a vortex of air around the one or more motors. The vortex of air is configured to dampen sound waves generated by the one or more motors.

According to this invention there is also provided a method of operating a machine for distributing loosefill insulation material from a package of compressed loosefill insulation material. The method includes the steps of loading compressed loosefill insulation material into a chute, guiding the compressed loosefill insulation material from the chute into a lower unit, the lower unit having a shredding chamber, the shredding chamber including a plurality of shredders configured to shred, pick apart and condition the loosefill insulation material, the plurality of shredders driven by one or more motors, the lower unit also having a discharge mechanism mounted to receive the conditioned loosefill insulation material exiting the shredding chamber, the discharge mechanism configured to distribute the conditioned loosefill insulation material into an airstream and forming a sound chamber within the lower unit, the sound chamber configured to receive the one or more motors and further configured to reduce the sound rating emanating from the machine.

According to this invention there is also provided a machine for distributing loosefill insulation material from a package of compressed loosefill insulation material. The machine includes a chute having an inlet end and an outlet end. The inlet end is configured to receive compressed loosefill insulation material. A lower unit has a shredding chamber configured to receive the compressed loosefill insulation material from the outlet end of the chute. The shredding chamber includes a plurality of shredders configured to shred, pick apart and condition the loosefill insulation material thereby forming conditioned loosefill insulation material. The plurality of shredders is driven by one or more motors. At least one of the motors is configured for operation on a maximum of 11.0 amps of direct current. A discharge mechanism is mounted to receive the conditioned loosefill insulation material exiting the shredding chamber. The discharge mechanism is configured to distribute the conditioned loosefill insulation material into an airstream. A blower is configured to provide the airstream flowing through the discharge mechanism.

Various objects and advantages of the loosefill insulation blowing machine with reduced sound ratings will become apparent to those skilled in the art from the following detailed description of the preferred embodiment, when read in light of the accompanying drawings.

DETAILED DESCRIPTION OF THE INVENTION

Figure 1:
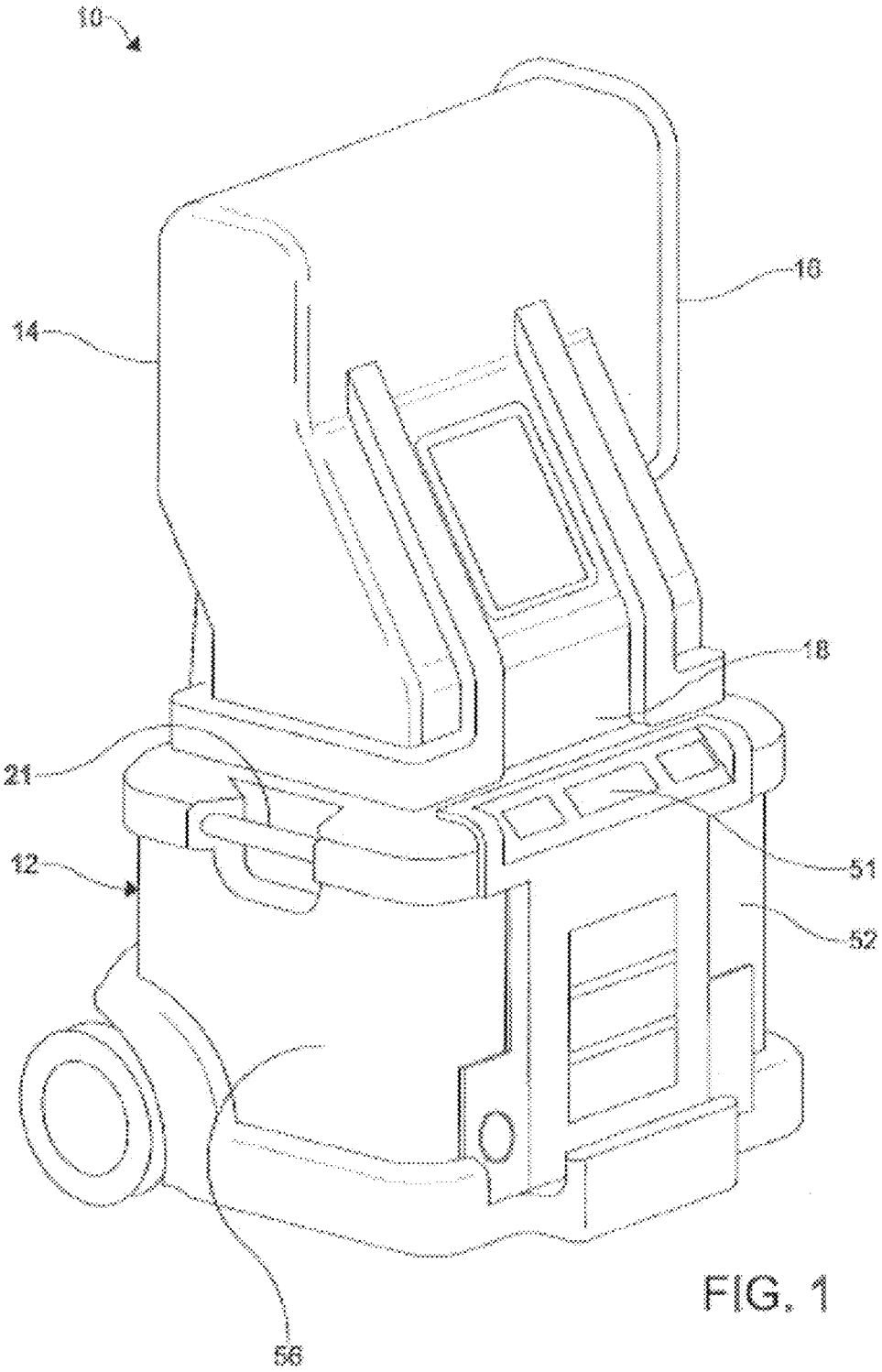
FIG. 1 is a front perspective view of an insulation blowing machine.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with illustrated embodiments of the present invention, the description and figures disclose a loosefill insulation blowing machine having reduced sound ratings. The reduction in the sound ratings occurs due to the structural arrangements of the sound producing components forming the loosefill insulation blowing machine. As a first example of a sound reducing arrangement, components responsible for generating a majority of the sound produced by the loosefill insulation blowing machine are enclosed in a sound reducing chamber. As a second example a sound reducing arrangement, certain components responsible for generating sound produced by the loosefill insulation blowing machine are positioned within an airflow, configured to muffle the generated sounds. As a third example a sound reducing arrangement, the airflow is further configured to dampen vibration of certain components of the loosefill insulation blowing machine. Finally, motors used to drive conditioning shredders have characteristics that provide less sound.

The term "loosefill insulation", as used herein, is defined to mean any insulating materials configured for distribution in an airstream. The term "finely conditioned", as used herein, is defined to mean the shredding, picking apart and conditioning of loosefill insulation material to a desired density prior to distribution into an airstream. The term "sound", as used herein, is defined to mean any vibration transmitted through an elastic solid, liquid or gas, with a frequency in a range capable of being detected by a human.

Referring now to FIGS. 1-4, a loosefill insulation blowing machine (hereafter "blowing machine") is shown generally at 10. The blowing machine 10 is configured for conditioning compressed loosefill insulation material and further configured for distributing the conditioned loosefill insulation material to desired locations, such as for example, insulation cavities. The blowing machine 10 includes a lower unit 12 and a chute 14. The lower unit 12 is connected to the chute 14 by one or more fastening mechanisms (not shown) configured to readily assemble and disassemble the chute 14 to the lower unit 12. The chute 14 has an inlet end 16 and an outlet end 18.

Referring again to FIGS. 1-4, the inlet end 16 of the chute 14 is configured to receive compressed loosefill insulation material. The compressed loosefill insulation material is guided within the interior of the chute 14 to the outlet end 18, wherein the loosefill insulation material is introduced to a shredding chamber 23 as shown in FIG. 3.

Referring again to FIGS. 1, 2 and 4, optionally the lower unit 12 can include one or more handle segments 21, configured to facilitate ready movement of the blowing machine 10 from one location to another. However, it should be understood that the one or more handle segments 21 are not necessary to the operation of the blowing machine 10.

Referring again to FIGS. 1-4, the chute 14 can include an optional bail guide (not shown for purposes of clarity) mounted at the inlet end 16 of the chute 14. The bail guide is configured to urge a package of compressed loosefill insulation material against an optional cutting mechanism (also not shown for purposes of clarity) as the package of compressed loosefill insulation material moves further into the chute 14. The bail guide and the cutting mechanism can have any desired structure and operation.

Figure 2:
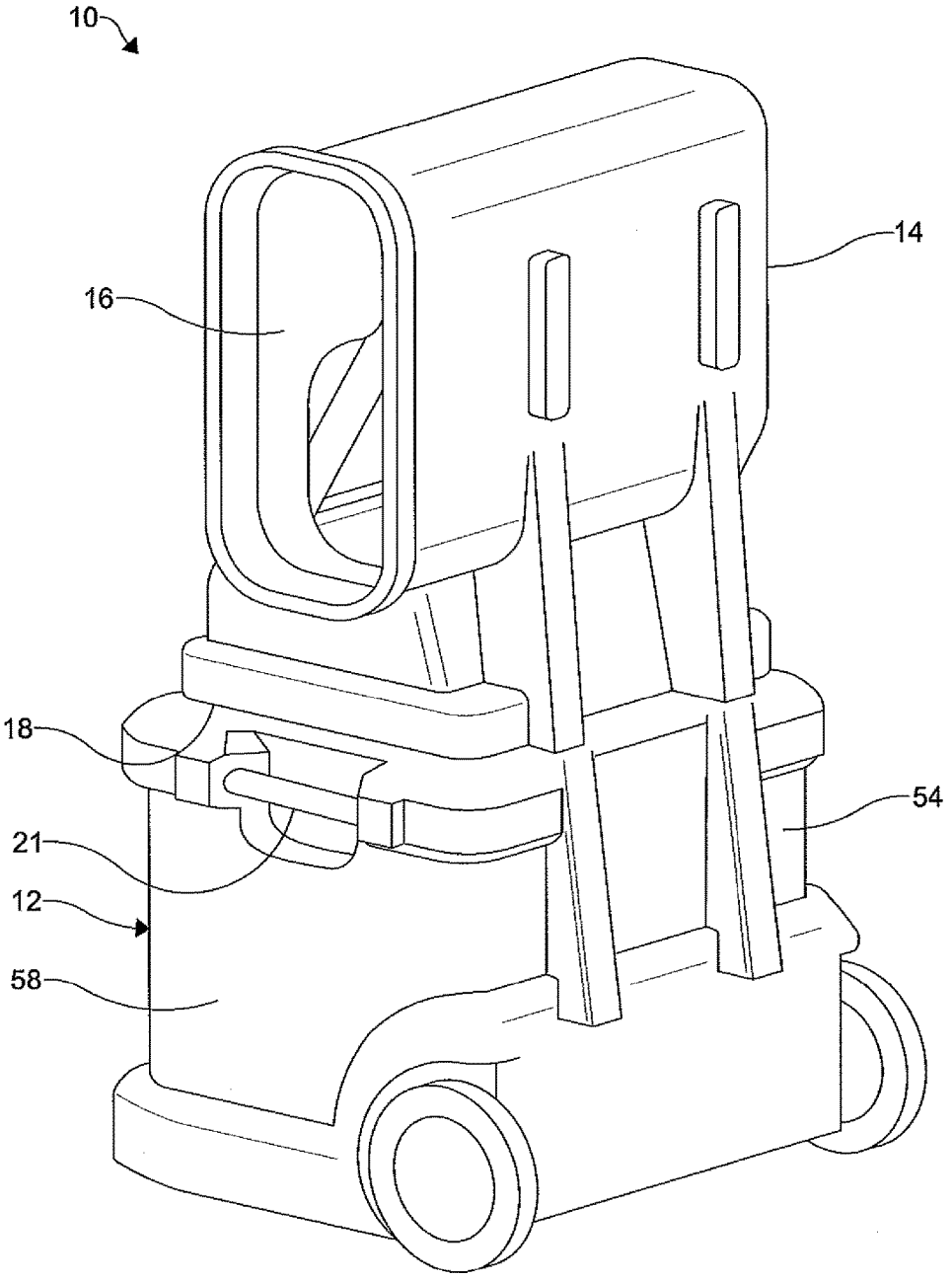
FIG. 2 is a rear perspective view of the insulation blowing machine of FIG. 1.
Figure 3:
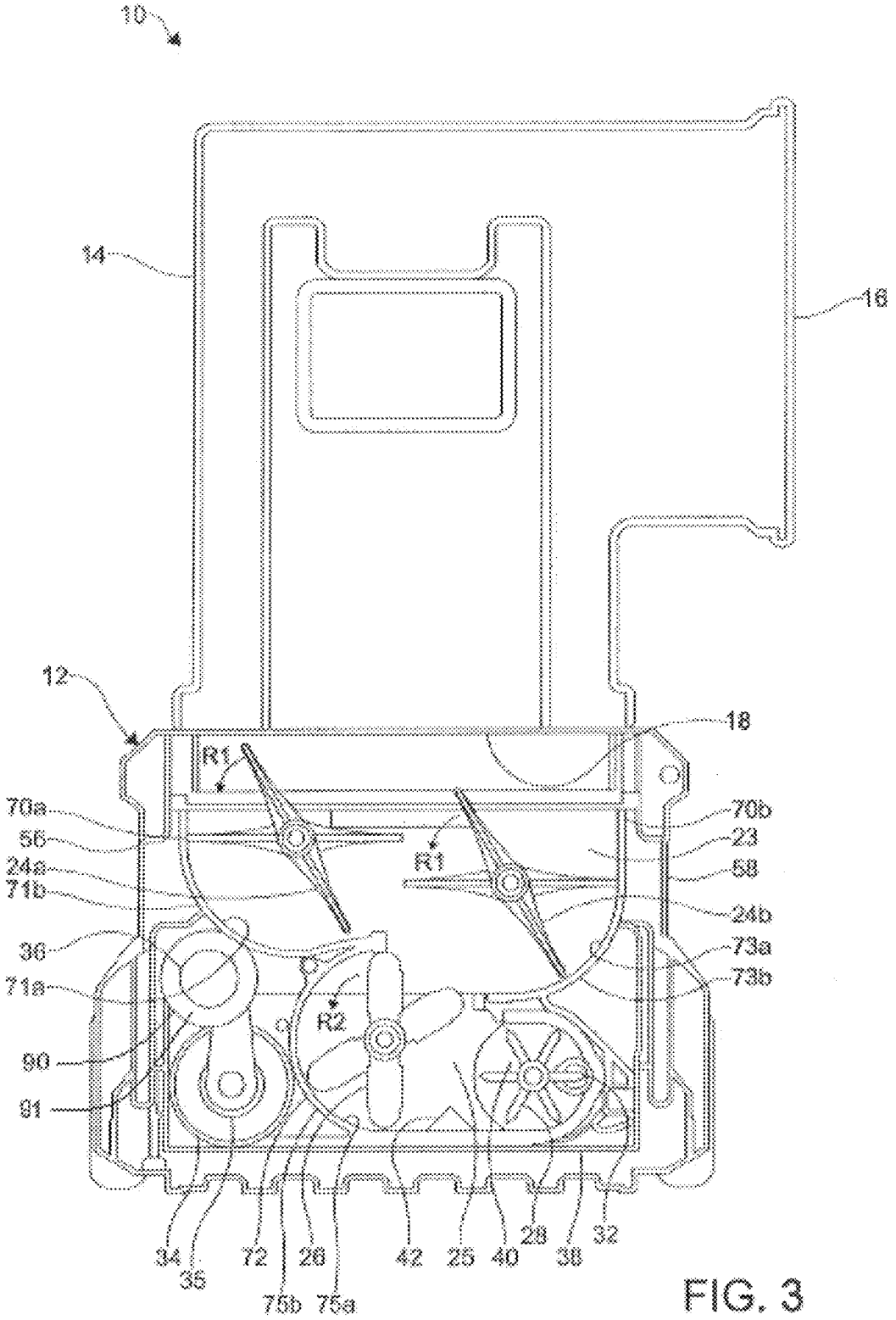
FIG. 3 is a front elevational view, partially in cross-section, of the insulation blowing machine of FIG. 1.

Referring now to FIGS. 1 and 2, the lower unit 12 includes a front panel 52, a back panel 54, a left side panel 56 and a right side panel 58. In the illustrated embodiment, the panels 52, 54, 56 and 58 are formed from a polymeric material. However, in other embodiments, the panels 52, 54, 56 and 58 can be formed from other desired materials including the non-limiting example of aluminum. The front panel 52, back panel 54, left side panel 56 and right side panel 58 will be discussed in more detail below.

Referring now to FIG. 3, the shredding chamber 23 is mounted at the outlet end 18 of the chute 14. The shredding chamber 23 includes first and second low speed shredders 24*a*, 24*b* and one or more agitators 26. The first and second low speed shredders 24*a*, 24*b* are configured to shred, pick apart and condition the loosefill insulation material as the loosefill insulation material is discharged into the shredding chamber 23 from the outlet end 18 of the chute 14. The agitator 26 is configured to finely condition the loosefill insulation material to a desired density as the loosefill insulation material exits the first and second low speed shredders 24*a*, 24*b*. It should be appreciated that although a quantity of two low speed shredders 24*a*, 24*b* and a lone agitator 26 are illustrated, any desired quantity of low speed shredders 24*a*, 24*b* and agitators 26 can be used. Further, although the blowing machine 10 is shown with first and second low speed shredders 24*a*, 24*b*, any type of separator, such as a clump breaker, beater bar or any other mechanism, device or structure that shreds, picks apart and conditions the loosefill insulation material can be used.

Referring again to FIG. 3, the first and second low speed shredders 24*a*, 24*b* rotate in a counter-clockwise direction R1 and the agitator 26 rotates in a counter-clockwise direction R2. Rotating the low speed shredders 24*a*, 24*b* and the agitator 26 in the same counter-clockwise direction allows the low speed shredders 24*a*, 24*b* and the agitator 26 to shred and pick apart the loosefill insulation material while substantially preventing an accumulation of unshredded or partially shredded loosefill insulation material in the shredding chamber 23. However, in other embodiments, each of the low speed shredders 24*a*, 24*b* and the agitator 26 could rotate in a clock-wise direction or the low speed shredders 24*a*, 24*b* and the agitator 26 could rotate in different directions provided the relative rotational directions allow finely shredded loosefill insulation material to be fed into the discharge mechanism 28 while preventing a substantial accumulation of unshredded or partially shredded loosefill insulation material in the shredding chamber 23.

Referring again to FIG. 3, the agitator 26 is configured to finely condition the loosefill insulation material, thereby forming finely conditioned loosefill insulation material and preparing the finely conditioned loosefill insulation material for distribution into an airstream. In the embodiment illustrated in FIG. 3, the agitator 26 is positioned vertically below the first and second low speed shredders 24*a*, 24*b*. Alternatively, the agitator 26 can be positioned in any desired location relative to the first and second low speed shredders 24*a*, 24*b*, sufficient to receive the loosefill insulation material from the first and second low speed shredders 24*a*, 24*b*, including the non-limiting example of being positioned horizontally adjacent to the first and second low speed shredders 24*a*, 24*b*. In the illustrated embodiment, the agitator 26 is a high speed shredder. Alternatively, the agitator 26 can be any type of shredder, such as a low speed shredder, clump breaker, beater bar or any other mechanism that finely conditions the loosefill insulation material and prepares the finely conditioned loosefill insulation material for distribution into an airstream.

In the embodiment illustrated in FIG. 3, the first and second low speed shredders 24*a*, 24*b* rotate at a lower rotational speed than the rotational speed of the agitator 26. The first and second low speed shredders 24*a*, 24*b* rotate at a rotational speed of about 40-80 rpm and the agitator 26 rotates at a rotational speed of about 300-500 rpm. In other embodiments, the first and second low speed shredders 24*a*, 24*b* can rotate at rotational speeds less than or more than 40-80 rpm and the agitator 26 can rotate at rotational speeds less than or more than 300-500 rpm. In still other embodiments, the first and second low speed shredders 24*a*, 24*b* can rotate at rotational speeds different from each other.

Referring again to FIG. 3, a discharge mechanism 28 is positioned adjacent to the agitator 26 and is configured to distribute the finely conditioned loosefill insulation material exiting the agitator 26 into an airstream. The finely conditioned loosefill insulation material is driven through the discharge mechanism 28 and through a machine outlet 32 by an airstream provided by a blower 34 and associated ductwork (not shown) mounted in the lower unit 12. The blower 34 is mounted for rotation and is driven by a blower motor 35. The airstream is indicated by an arrow 33 in FIG. 4. In other embodiments, the airstream 33 can be provided by other methods, such as by a vacuum, sufficient to provide an airstream 33 driven through the discharge mechanism 28.

Referring again to FIG. 3, the first and second shredders 24*a*, 24*b*, agitator 26 and discharge mechanism 28 are mounted for rotation. They can be driven by any suitable means, such as by an electric motor 36, or other means sufficient to drive rotary equipment. Alternatively, each of the first and second shredders 24*a*, 24*b*, agitator 26 and discharge mechanism 28 can be provided with its own source of rotation.

Referring again to FIG. 1, the blowing machine 10 includes a control panel 51. The control panel 51 includes a plurality of control devices configured to direct certain operating characteristics of the blowing machine 10, including functions such as starting and stopping of the motors 35, 36.

Referring again to FIG. 3, the lower unit 12 includes a first shredder guide shell 70*a*, a second shredder guide shell 70*b* and an agitator guide shell 72. The first shredder guide shell 70*a* is positioned partially around the first low speed shredder 24*a* and extends to form an arc of approximately 90°. The first shredder guide shell 70*a* has an inner surface 71*a* and an outer surface 71*b*. The first shredder guide shell 70*a* is configured to allow the first low speed shredder 24*a* to seal against the inner surface 71*a* of the shredder guide shell 70*a* and thereby urge loosefill insulation material in a direction toward the second low speed shredder 24*b*.

Referring again to FIG. 3, second shredder guide shell 70*b* is positioned partially around the second low speed shredder 24*b* and extends to form an arc of approximately 90°. The second shredder guide shell 70*b* has an inner surface 73*a* and an outer surface 73*b*. The second shredder guide shell 70*b* is configured to allow the second low speed shredder 24*b* to seal against the inner surface 73*a* of the second shredder guide shell 70*b* and thereby urge the loosefill insulation in a direction toward the agitator 26.

In a manner similar to the shredder guide shells, 70*a*, 70*b*, the agitator guide shell 72 is positioned partially around the agitator 26 and extends to form an arc of approximate 90°. The agitator guide shell 72 has an inner surface 75*a* and an outer surface 75*b*. The agitator guide shell 72 is configured to allow the agitator 26 to seal against the inner surface 75*a* of the agitator guide shell 72 and thereby direct the loosefill insulation in a downstream direction toward the discharge mechanism 28.

In the embodiment illustrated in FIG. 3, the shredder guide shells 70*a*, 70*b* and the agitator guide shell 72 are formed from a polymeric material. However, in other embodiments, the shells 70*a*, 70*b* and 72 can be formed from other desired materials including the non-limiting example of aluminum.

Referring again to FIG. 3, the shredding chamber 23 includes a floor 38 positioned below the blower 34, the agitator 26 and the discharge mechanism 28. In the illustrated embodiment, the floor 38 is arranged in a substantially horizontal plane and extends substantially across the lower unit 12. In the embodiment illustrated in FIG. 3, the floor 38 is formed from a polymeric material. However, in other embodiments, the floor 38 can be formed from other desired materials including the non-limiting example of aluminum.

Referring again to FIGS. 1-4, in operation, the inlet end 16 of the chute 14 receives compressed loosefill insulation material. As the compressed loosefill insulation material expands within the chute 14, the chute 14 guides the loosefill insulation material past the outlet end 18 of the chute 14 to the shredding chamber 23. The first low speed shredder 24*a* receives the loosefill insulation material and shreds, picks apart and conditions the loosefill insulation material. The loosefill insulation material is directed by the combination of the first low speed shredder 24*a* and the first shredder guide shell 70*a* to the second low speed shredder 24*b*. The second low speed shredder 24*b* receives the loosefill insulation material and further shreds, picks apart and conditions the loosefill insulation material. The loosefill insulation material is directed by the combination of the second low speed shredder 24*b* and the second shredder guide shell 70*b* to the agitator 26.

Figure 4:
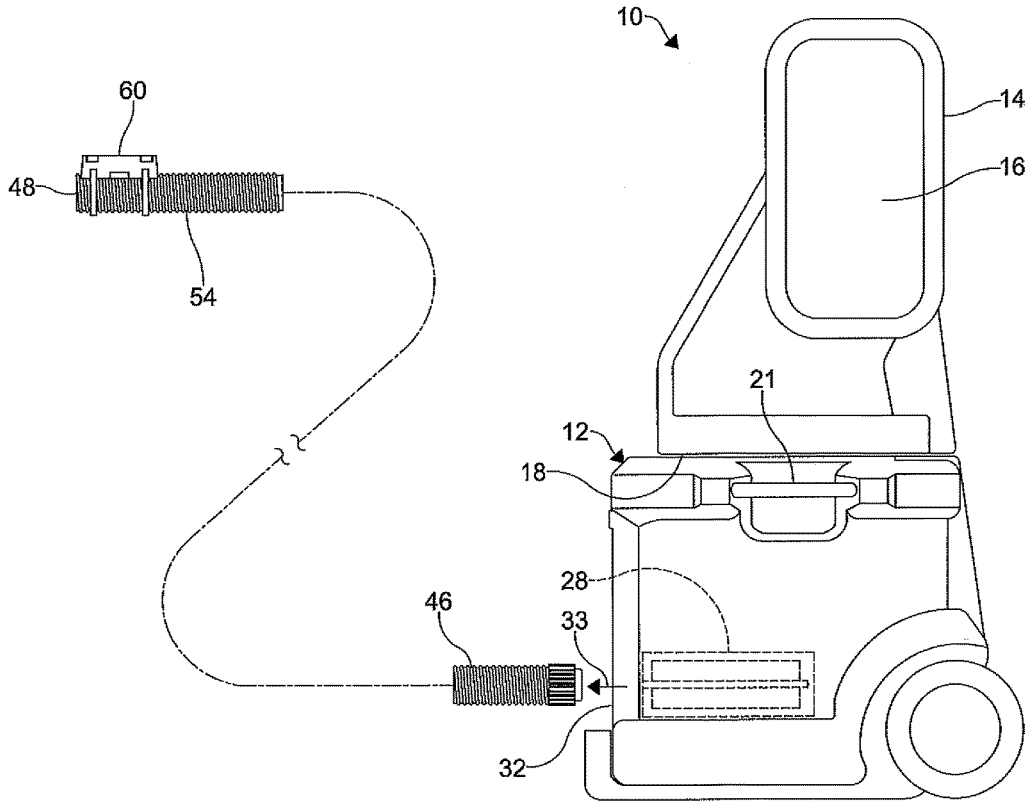
FIG. 4 is a side elevational view of the insulation blowing machine of FIG. 1, illustrating a distribution hose.

The agitator 26 is configured to finely condition the loosefill insulation material and prepare the loosefill insulation material for distribution into the airstream 33 by further shredding and conditioning the loosefill insulation material. The finely conditioned loosefill insulation material, guided by the agitator guide shell 72, exits the agitator 26 at the outlet end 25 of the shredding chamber 23 and enters the discharge mechanism 28 for distribution into the airstream 33 provided by the blower 34. The airstream 33, entrained with the finely conditioned loosefill insulation material, exits the insulation blowing machine 10 at the machine outlet 32 and flows through a distribution hose 46, as shown in FIG. 4, toward an insulation cavity, not shown.

Referring again to FIG. 3, the discharge mechanism 28 has a side inlet 40 and an optional choke 42. The side inlet 40 is configured to receive the finely conditioned blowing insulation material as it is fed from the agitator 26. In the illustrated embodiment, the agitator 26 is positioned adjacent to the side inlet 40 of the discharge mechanism 28. In other embodiments, the low speed shredders 24*a*, 24*b* or agitator 26, or other shredding mechanisms can be positioned adjacent to the side inlet 40 of the discharge mechanism 28 or in other suitable positions.

Referring again to FIG. 3, the optional choke 42 is configured to partially obstruct the side inlet 40 of the discharge mechanism 28 such that heavier clumps of blowing insulation material are prevented from entering the side inlet 40 of the discharge mechanism 28. The heavier clumps of blowing insulation material are redirected past the side inlet 40 of the discharge mechanism 28 to the shredders 24*a*, 24*b* for recycling and further conditioning.

As discussed above, the blowing machine 10 is configured to provide reduced sound ratings when compared to prior art blowing machines. It is believed the reduction in the sound ratings occurs primarily as the result of four factors. First, components responsible for generating a majority of the sound produced by the blowing machine are enclosed in a sound chamber configured to dampen the sound. Second, certain components responsible for generating sound are positioned within an airflow, configured to muffle the generated sounds. Third, the airflow is further configured to dampen sound producing vibrations caused by certain components of the blowing machine. Finally, motors used to drive rotary equipment are of a size and type to reduce emitted sound levels. Each of these factors will be discussed in more detail below.

Figure 5:
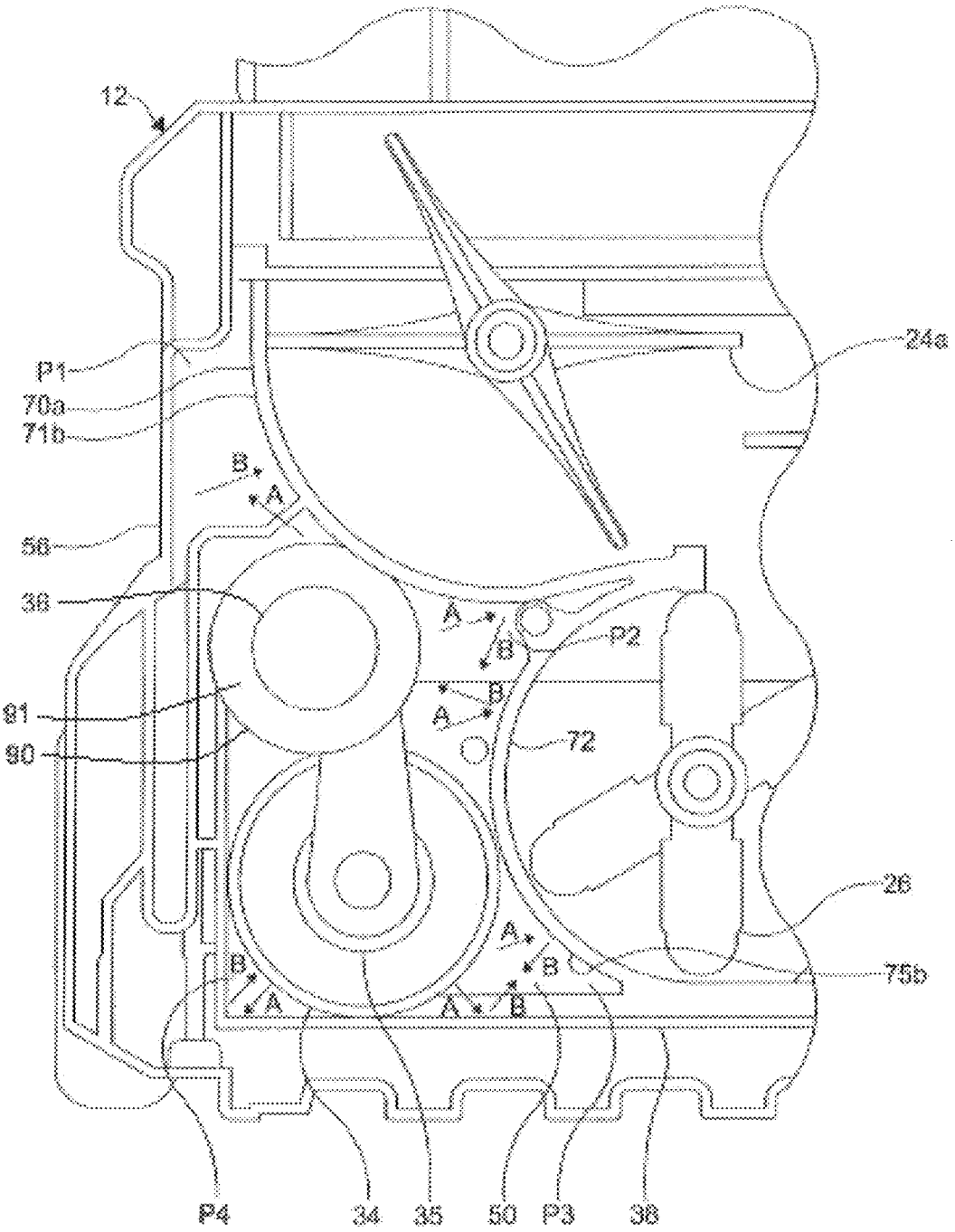
FIG. 5 is an enlarged front view of a portion of the lower unit of FIG. 3 illustrating a sound chamber.

Referring now to FIG. 5, an enlarged view of a portion of the lower unit 12 is illustrated. A sound chamber 50 is formed within the lower unit 12 and is defined by the outer surface 71*b* of the first low speed shredder 24*a*, the outer surface 75*b* of the agitator guide shell 72, the floor 38, an inside surface of the left side panel 56, an inside surface of the front panel 52 (not shown) and an inside surface of the back panel 54 (not shown). The blower 34 and its associated blower motor 35 are positioned within the sound chamber 50. Similarly, the motor 36 for driving the rotary equipment is also positioned within the sound chamber 50. The sound chamber 50 is configured to substantially reduce the level of the sound emitted from the blowing machine 10 by reflecting a large portion of the sound (illustrated by arrows A) generated by the blower 34, blower motor 35 and the motor 36 back into the interior of the sound chamber 50 (illustrated by direction arrows B). In this manner, the sound chamber 50 is configured to substantially enclose the sound generated by the blower motor 35 and the motor 36 within the sound chamber.

In the embodiment shown in FIG. 5, the outer surfaces 71*b*, 75*b* of the first shredder 24*a* and the agitator 26, and the inner surfaces of the left side panel 56 and the floor 38 have a substantially flat surface. However, it is within the contemplation of this invention that these surfaces can be textured, coated or covered with one or more materials configured to absorb sound. Non-limiting examples of sound absorbing materials include sprays, foams, epoxies, high density insulative materials and lattices formed from fibrous materials.

Referring again to FIG. 5, the sound chamber 50 has an irregular cross-sectional outline. That is, the sound chamber 50 is defined by surfaces having an arcuate cross-sectional shape, as formed by the first shredder and agitator guide shells 70*a*, 72 and surfaces having a flat cross-sectional shape, as formed by the floor 38, the left side panel 56, the front panel and the rear panel. In addition, the various surfaces forming the sound chamber 50 cooperate to form pockets P1, P2, P3 and P4. The term "pockets", as used herein, is defined to mean small, confined areas with limited ingress and egress. Without being held to the theory, it is believed the irregular cross-sectional shapes of the sound chamber 50, coupled with the pockets P1-P4, combine to substantially "capture" sound produced by the blower 34, its associated blower motor 35 and the motor 36, within the sound chamber 50, thereby limiting the level of sound emitted by the blowing machine 10. While the illustrated embodiment, shows various surfaces having arcuate or flat cross-sectional shapes and pockets P1-P4, it should be appreciated that the sound chamber 50 can be formed with more or less arcuate or flat cross-sectional shapes and more or less pockets.

Figure 6:
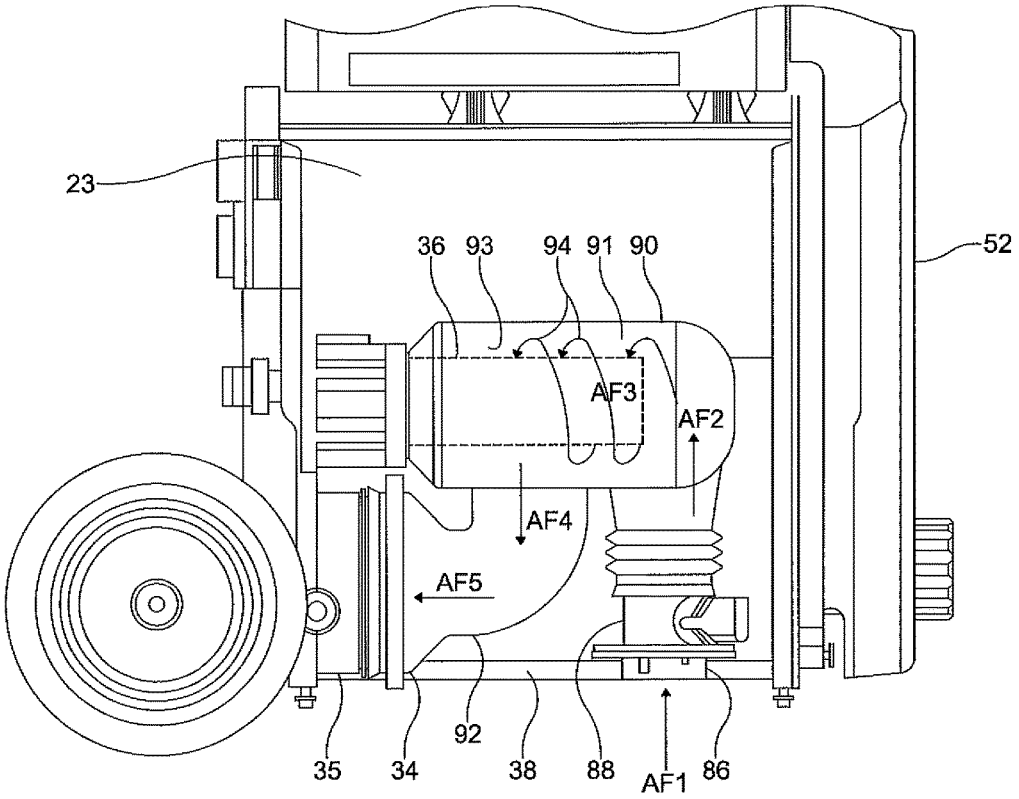
FIG. 6 is an enlarged side view of the lower unit of FIG. 3 showing a motor enclosure.

As discussed above, another factor in the reduction of the sound rating of the blowing machine is an airflow, configured to muffle certain sounds produced within the blowing machine. Referring now to FIG. 6, an enlarged side view of a portion of the lower unit 12 is illustrated. The blower 34 and the blower motor 35 are positioned adjacent the floor 38. The motor 36 configured to drive certain rotary components is positioned vertically above the blower 34. A port 86 extends through the floor 38 and is configured as an inlet for an airflow as shown by arrow AF1. The port 86 is fluidly connected to a first ductwork 88 configured as a conduit for the airflow AF1 entering the port 86. The ductwork 88 is fluidly connected to a motor enclosure 90. The motor enclosure 90 is configured to enclose the motor 36. A cavity 91 is formed in a circumferential space between an exterior surface of the motor 36 and an interior circumferential surface 93 of the motor enclosure 90. In the illustrated embodiment, the enclosure 90 has a cylindrical shape. However, the enclosure 90 can have other shapes sufficient to enclose the motor 36 while forming a cavity between an exterior surface of the motor 36 and the interior circumferential surface 93 of the motor enclosure 90. The cavity 91 within the motor enclosure 90 is configured to receive the airflow as indicated by arrow AF2. The cavity 91 will be discussed in more detail below.

Referring again to FIG. 6, cavity 91 within the motor enclosure 90 is fluidly connected to a second ductwork 92 extending from the motor enclosure 90 to the blower 34. The second ductwork 92 is configured as a conduit for an airflow, indicated by arrow AF4, and can have any desired structure.

In operation, the blower 34 develops an airflow through the lower unit 12 as described in the following steps. In an initial step, operation of the blower 34 creates a vacuum that extends through the second ductwork 92, the cavity 91 within the enclosure 90 and through the first ductwork 88 to the port 86. The vacuum creates the airflow AF1. The airflow AF1 flows into the port 86, through the first ductwork 88 and into the cavity 91 within the enclosure 90 as indicated by arrow AF2. Once in the enclosure 90, the airflow encircles the motor 36, thereby creating a vortex of air 94 as indicated by arrows AF3. The term "vortex of air", as used herein, is defined to mean a mass of swirling air. The vortex 94 encircles the motor 36 and finally flows through into the second ductwork 92 as indicated by arrow AF4. The airflow continues flowing into the blower 34 as shown by arrow AF5.

Referring again to FIG. 6, the vortex of air 94 provides advantageous benefits. First, without being held to the theory, it is believed the vortex of air 94 dampens sound generated by the motor 36, thereby reducing the sound ratings of the blowing machine 10. Second, it is believed the vortex of air 94 assists in dampening rotational vibrations of the motor 36. The rotational vibrations of the motor 36 are another source of sound. Accordingly, dampening of the rotational vibrations of the motor 36 serves to reduce the sound emanating from the motor 36.

In the illustrated embodiment, the interior circumferential surface 93 of the motor enclosure 90 has a substantially smooth surface. However, in other embodiments, the interior circumferential surface 93 of the motor enclosure 90 can have structures configured to direct the direction of the vortex of air and/or form desired vortex of air patterns. Non-limiting examples of structures for directing and/or forming vortex patterns include fins, ribs, grooves, projections and the like. In still other embodiments, the interior circumferential surface 93 can be textured, coated or covered with one or more materials configured to absorb sound. Non-limiting examples of sound absorbing materials include sprays, foams, epoxies, high density insulative materials and lattices formed from fibrous materials.

Referring again to FIG. 6, the blower motor 35 and the motor 36 are illustrated. As discussed above, the motors 35, 36 are of a size and type to reduce emitted sound levels. Specifically, the blower motor 35 is configured for 120 volt alternating current (A.C.) operation and the motor 36 is configured for 120 volt direct current (D.C.) operation. Both motors 35, 36 are sized to require a maximum of 11.0 amps. Further, the motors 35, 36 are of a flow though type and have a maximum rotational speed of 34,000 revolutions per minute. Without being held to the theory, it is believed motors of this small size and operational type generate less sound than typical blowing machine motors for several reasons. First, the maximum size of 11.0 amps results in a smaller motor frame and associated rotor. Small motor frames and rotors output less sound. Second, control systems controlling the motors 35, 36 are configured to permit the motors 35, 36 to be operated at less than full rotational speed, thereby generating less sound than operations at full rotational speed.

Figure 7:
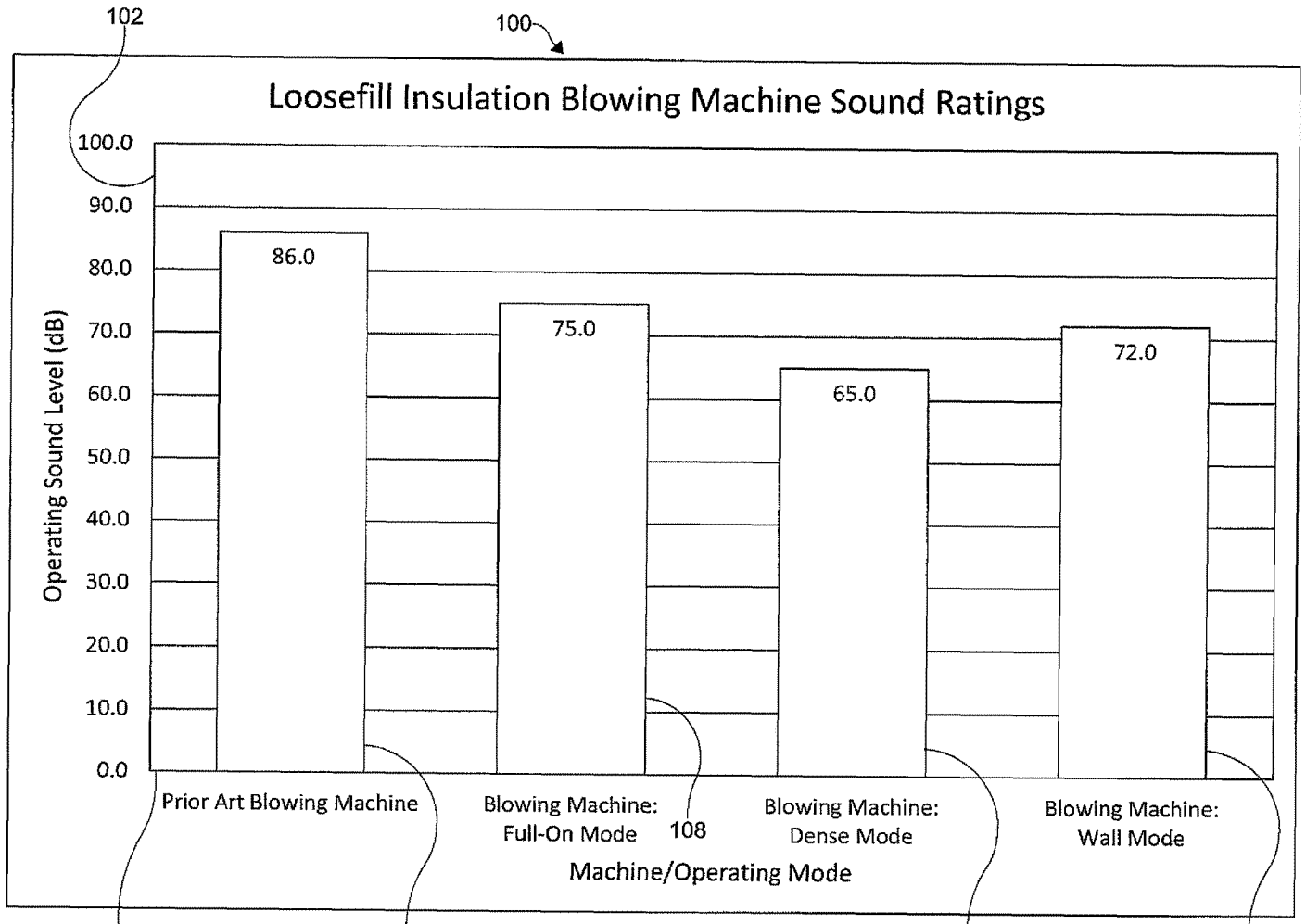
FIG. 7 is a chart illustrating the sound ratings of the insulation blowing machine of FIG. 1 in various operating modes.

As discussed above, the blowing machine 10 is configured to provide reduced sound ratings when compared to prior art blowing machines. Referring now to FIG. 7, the sound ratings of the blowing machine 10, operating in different modes, are illustrated in a graph 100. The graph 100 has a vertical axis 102 titled "Operating Sound Levels". The unit of measure of the vertical axis 102 is decibels (db.). The horizontal axis 104 includes test results from a Prior Art Machine, shown as vertical bar 106, Blowing Machine in a Full-On Mode, shown as vertical bar 108, Blowing Machine in a Dense Mode, shown as vertical bar 110 and Blowing Machine in a Wall Mode, shown as vertical bar 112. All of the sound ratings were made with the measuring equipment positioned four feet from the machine and four feet from the ground.

Referring again to FIG. 7, the Prior Art Machine 106 registered a sound rating of 86.0 decibels. The test for the Prior Art Machine 106 was run with the Prior Art Machine in a full speed mode, that is, in a mode to maximize the output of the machine.

Referring again to FIG. 7, the Blowing Machine in a Full-On Mode 108 registered a sound rating of 75.0 decibels (db.). The term "Full-On Mode", as used herein, is defined to mean the blower 34 is configured to provide an airstream 33 with a high volume and a high velocity. The high volume and high velocity of the airstream 33 results in the blown loosefill insulation material having a low density when installed in an insulation cavity. As one example, the full-on mode can result in an installed density in a range of from about 0.40 pounds per cubic foot to about 0.60 pounds per cubic foot. The full-on mode is configured for effectively insulating typical open insulation cavities, such as for example, an attic expanse. As shown by the graph 100, the sound rating for the Blowing Machine in a Full-On Mode 108 is less than the sound rating for the Prior Art Machine 106.

Referring again to FIG. 7, the Blowing Machine in a Dense Mode 110 registered a sound rating of 65.0 decibels (db.). The term "Dense Mode", as used herein, is defined to mean the blower motor 35 operates at a lower rotational speed. Accordingly, the blower 34 provides an airstream 33 having less volume and a slower velocity. Since the airstream 33 has less volume and a slower velocity, the resulting density of the blown loosefill insulation material is higher than that achieved when the blower 34 is operating at the full-on mode. As one non-limiting example, in the Dense Mode the blower 34 can operate at 40.0% of the rotational speed of the full-on mode. The resulting density of the blown loosefill insulation material is then in a range of from about 0.60 pounds per cubic foot to about 1.00 pounds per cubic foot. The increased density of the blown loosefill insulation material can be advantageously used for insulating difficult to reach areas, such as for example eaves and around obstructions. Since the density of the blown loosefill insulation material is higher around the difficult to reach areas, the resulting insulative value (R-value) of the blown loosefill insulation material in these areas is correspondingly higher. As shown by the graph 100, the sound rating for the Blowing Machine in a Dense Mode 110 is less than the sound rating for the Prior Art Machine 106 and less than the sound rating of the Blowing Machine in the Full-On Mode 108.

Referring again to FIG. 7, the Blowing Machine in a Wall Mode 112 registered a sound rating of 72.0 decibels (db.). The term "Wall Mode", as used herein, is defined to mean the blower 34 is configured to provide an airstream 33 with the volume and velocity sufficient to fill an insulation cavity within the confinement of a wall structure, typically through a small inlet opening. The wall cavity is typically formed between framing members and between external sheathing and internal wall panels. The wall mode volume and velocity of the airstream 33 results in the blown loosefill insulation material having an installed density in a range of from about 0.50 pounds per cubic foot to about 0.90 pounds per cubic foot. As shown by the graph 100, the sound rating for the Blowing Machine in a Wall Mode 112 is less than the sound rating for the Prior Art Machine 106 and less than the sound rating of the Blowing Machine in the Full-On Mode 108.

Referring again to FIG. 7, it can be seen that the blowing machine 10, when operated in any of the illustrated modes 108, 110 or 112, is quieter than the prior art machine 106.

The principle and mode of operation of the loosefill insulation blowing machine having reduced sound ratings have been described in certain embodiments. However, it should be noted that the loosefill insulation blowing machine having reduced sound rating may be practiced otherwise than as specifically illustrated and described without departing from its scope.

What is claimed is:

1. A machine for distributing loosefill insulation material from a package of compressed loosefill insulation material, the machine comprising:

a chute having an inlet end and an outlet end, the inlet end configured to receive compressed loosefill insulation material;

a lower unit having:

a shredding chamber configured to receive the compressed loosefill insulation material from the outlet end of the chute, the shredding chamber including a plurality of shredders configured to shred, pick apart and condition the loosefill insulation material thereby forming conditioned loosefill insulation material, the plurality of shredders driven by one or more motors;

a discharge mechanism mounted to receive the conditioned loosefill insulation material exiting the shredding chamber, the discharge mechanism configured to distribute the conditioned loosefill insulation material into an airstream;

a blower configured to provide the airstream flowing through the discharge mechanism; and a sound chamber configured to receive the one or more motors and further configured to reduce the sound rating emanating from the machine, wherein the sound chamber is defined by an outer surface of a first low speed shredder of the plurality of shredders, an outer surface of an agitator guide, a floor, an inside surface of a left side panel, an inside surface of a front panel and an inside surface of a back panel.

2. The machine of claim 1, wherein the one or more motors received by the sound chamber includes a blower motor.

3. The machine of claim 1, wherein the one or more motors received by the sound chamber includes a motor for driving rotary equipment.

4. The machine of claim 1, wherein the surfaces forming the sound chamber have an irregular cross-sectional shape.

5. The machine of claim 1, wherein the surfaces forming the sound chamber has surfaces forming form pockets configured to substantially capture sounds generated by the one or more motors.

6. The machine of claim 1, wherein the sound chamber is configured to reflect sounds waves generated by the one or more motors back into an interior of the sound chamber.

7. A machine for distributing loosefill insulation material from a package of compressed loosefill insulation material, the machine comprising:

a chute having an inlet end and an outlet end, the inlet end configured to receive compressed loosefill insulation material;

a lower unit having:

a shredding chamber configured to receive the compressed loosefill insulation material from the outlet end of the chute, the shredding chamber including a plurality of shredders configured to shred, pick apart and condition the loosefill insulation material thereby forming conditioned loosefill insulation material, the plurality of shredders driven by one or more motors;

a discharge mechanism mounted to receive the conditioned loosefill insulation material exiting the shredding chamber, the discharge mechanism configured to distribute the conditioned loosefill insulation material into an airstream;

a blower configured to provide the airstream flowing through the discharge mechanism; and a motor enclosure configured to enclose the one or more motors, the motor enclosure configured to receive a flow of air and form a vortex of air around the one or more motors, the vortex of air configured to dampen sound waves generated by the one or more motors.

8. The machine of claim 7, wherein the one or more motors enclosed by the motor enclosure is a shredder motor.

9. The machine of claim 7, wherein the flow of air received by the motor enclosure flows from a port positioned in a floor of the machine.

10. The machine of claim 7, wherein the flow of air received by the motor enclosure is generated by the blower.

11. The machine of claim 7, wherein the motor enclosure forms a cavity between an exterior surface of the motor and an internal circumferential surface of the motor enclosure.

12. The machine of claim 7, wherein the vortex of air is further configured to dampen rotational vibrations generated by the one or more motors.

13. A method of operating a machine for distributing loosefill insulation material from a package of compressed loosefill insulation material, the method comprising the steps of:

loading compressed loosefill insulation material into a chute;

guiding the compressed loosefill insulation material from the chute into a lower unit, the lower unit having a shredding chamber, the shredding chamber including a plurality of shredders configured to shred, pick apart and condition the loosefill insulation material, the plurality of shredders driven by one or more motors, the lower unit also having a discharge mechanism mounted to receive the conditioned loosefill insulation material exiting the shredding chamber, the discharge mechanism configured to distribute the conditioned loosefill insulation material into an airstream; and providing a sound chamber within the lower unit to reduce the sound rating emanating from the machine, the sound chamber configured to receive the one or more motors and having an outer surface of an agitator guide, a floor, an inside surface of a left side panel, an inside surface of a front panel and an inside surface of a back panel.

14. The method of claim 13, wherein the one or more motors received by the sound chamber includes a blower motor.

15. The method of claim 13, wherein the sound chamber is configured to reflect sound waves generated by the one or more motors back into an interior of the sound chamber.

16. The method of claim 13, including the steps of enclosing the one or more motors and providing a flow of air to the motor enclosure, the motor enclosure configured to form a vortex of air around the one or more motors, the vortex of air thereby dampening sound waves generated by the one or more motors.

17. The method of claim 16, wherein the one or more motors enclosed by the motor enclosure is a shredder motor.

18. The method of claim 16, wherein the flow of air received by the motor enclosure flows from a port positioned in a floor of the machine.

19. The method of claim 16, wherein the flow of air received by the motor enclosure is generated by the blower.

* * * * *